US006112541A

United States Patent [19]

Greene

[11] Patent Number: 6,112,541

[45] Date of Patent: Sep. 5, 2000

[54] COMPACT COOLING APPARATUS

[76] Inventor: Ralph G. Greene, 702 S. Thornton Ave., Suite C, P.O. Box 2766, Dalton, Ga. 30720

[21] Appl. No.: 09/392,370

[22] Filed: Sep. 8, 1999

[51] Int. Cl.[7] ..... B67D 5/62

[52] U.S. Cl. ..... 62/389; 62/3.64; 62/3.2; 222/146.6

[58] Field of Search ..... 62/3.64, 3.2, 3.89; 222/146.6

[56] References Cited

U.S. PATENT DOCUMENTS 4,923,091 5/1990 Sutera ..... 222/146.6 X
5,617,736 4/1997 Ito et al. ..... 222/146.6 X

*Primary Examiner*—Henry Bennett
*Assistant Examiner*—Chen-Wen Jiang
*Attorney, Agent, or Firm*—Alan Ruderman; Miller & Martin LLP

[57] ABSTRACT

A compact chiller for receiving supply temperature water from a source as a chilling tank in which a thermally conductive chilling probe is positioned for chilling the water in the tank. Supply water is fed through the tank and to the inlet of a valve selectively positionable between open and closed positions so that water from the supply may entirely flow into the tank or have a portion flowing into the tank and the remainder through the valve. A chilled water supply tube within the tank and the outlet of the valve communicate the inlet to a spout so that chilled water or a mixture of chilled water and entering supply water may be dispensed from the faucet. The supply water may be water from the faucet of a sink diverter valve to the chiller. Filters may be connected in communication between the faucet and the entry into the chiller tank.

5 Claims, 1 Drawing Sheet

COMPACT COOLING APPARATUS

BACKGROUND OF THE INVENTION

This invention relates to the cooling of water in a dispenser which may dispense water which is chilled, water at substantially room temperature or mixtures of water at these temperatures, and more particularly to such a dispenser which may be located on a counter adjacent to sink and be connected in communication with the water at the sink faucet.

A conventional chiller or cooler used for dispensing liquids such as a cooler/dispenser used for bottled water utilizes refrigeration equipment including a compressor unless the liquid is within a reservoir surrounded by ice or a refrigerant or other heat transfer medium. Examples, of the latter are illustrated in Pique U.S. Pat. No. 2,506,840; Olson U.S. Pat. No. 2,821,844; Geisler U.S. Pat. No. 3,270,520 and Bonimi U.S. Pat. No. 4,238,053; while examples of the former are illustrated in Natter U.S. Pat. No. 3,462,970 and Schroeder U.S. Pat. No. 3,892,335; while Radino U.S. Pat. No. 5,079,927 illustrates a hybrid combination of these. In Moren U.S. Pat. No. 5,544,489 there is disclosed a thermoelectric device having a probe that extends into water within a receptacle to cool the liquid, the thermoelectric device being one which responds to a direct current input to provide one side relatively cooled and one side relatively heated.

SUMMARY OF THE INVENTION

Consequently, it is the primary object of the present invention to provide a cooler which permits water to be effectively chilled and dispensed as chilled water or mixed with room temperature water to dispense water of temperatures varying selectively between the chilled water temperature and the room temperature water.

It is another object of the present invention to provide a compact water cooler or chiller which may sit on a counter top adjacent to the sink and permit water to be chilled and dispensed and which permits the chilled water to be mixed selectively with room temperature water.

It is further object of the present invention to provide a compact counter top cooler or chiller which may be connected to a diverter valve to the faucet of a sink for receiving room temperature water, chilling this water in a tank and dispensing the chilled water unmixed or mixed with room temperature water received from the faucet through a spout connected to the tank.

It is still a further object of the present invention to provide a compact counter top cooler or chiller which may be connected through a diverter valve to the faucet of a sink for receiving room temperature water through filtering means, chilling this filtered water in a tank and dispensing the chilled water unmixed or mixed with room temperature water through a spout connected to the tank.

Accordingly, the present invention provides a compact cooler or chiller which may receive supply temperature water from an in line source, chill the water in a tank or chilling chamber and dispense the chilled water selectively either as fully chilled or mixed in different amounts with room temperature water through a spout. The cooler may sit on a counter top adjacent a sink and be connected to the water faucet of the sink by means of a diverter valve such that the cooler may be engaged selectively. Preferably, cooling is effected by a thermally conductive probe such as that disclosed in Moren, U.S. Pat. No. 5,544,489 disposed within the cooler tank, the probe being connected to the cold side of the thermoelectric device having its hot side connected to a heat sink outside the tank. A shut-off valve connected in line with the water inlet permits all the water from the source to flow into the tank and be chilled and dispensed or permits a proportion of the room temperature water to flow into the tank and the remainder to by-pass the tank and mix with the water from the tank. Thus, the water temperature at the outlet spout may be adjusted selectively. Moreover, the chiller may include filter means through which water from the source may flow prior to being dispensed either as chilled water or as a mixture of chilled and room temperature water.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
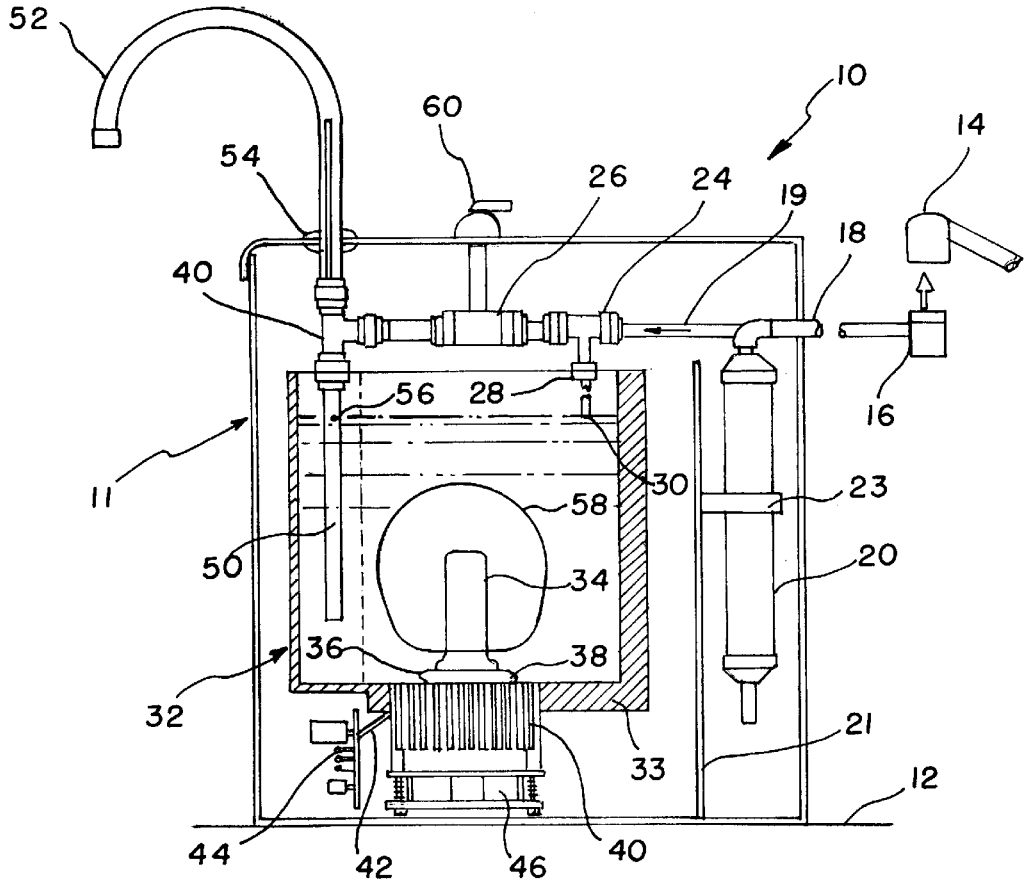
FIG. 1 is a diagrammatic side elevational view partly in cross section of cooler apparatus constructed in accordance with the present invention.
Figure 2:
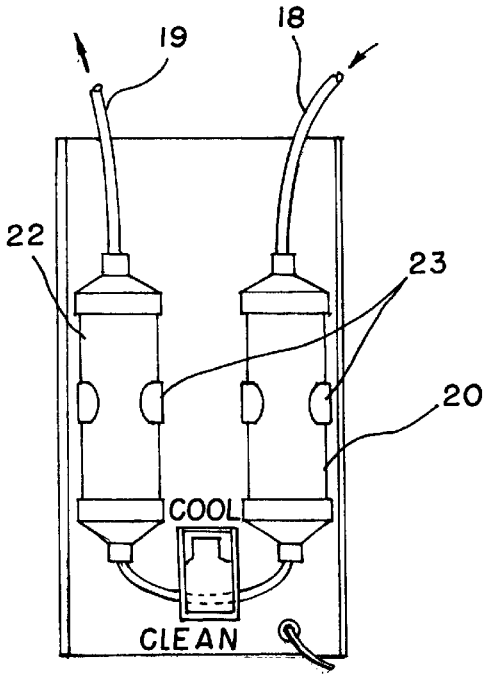
FIG. 2 is a rear elevational view of the housing of the apparatus of FIG. 1.
Figure 3:
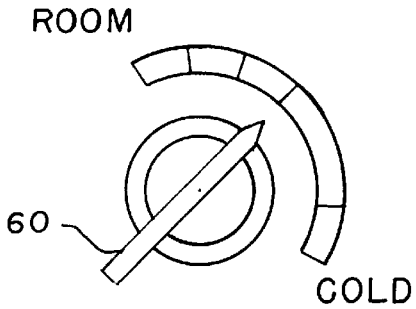
FIG. 3 is a schematic view of the temperature selection indicator.

Referring to the drawings, FIG. 1 illustrates compact cooling and chilling apparatus 10 including a housing 11 which may sit on a counter top 12 and be supplied with water from the faucet 14 of a sink (not illustrated) of a kitchen, the faucet 14 having an adapter with a diverter valve 16 so that water from the sink may flow into the sink or into the inlet line 18 of the apparatus. Preferably, the cooling apparatus includes filter means which in the preferred embodiment comprises a pair of filters 20, 22, the filter 20 being a sediment trapping filter connected at its inlet to the inlet line 18 and having an outlet connected to the inlet of the filter 22 which is connected to an outlet line 19. The filter 22 preferably is a conventional carbon filter which removes the various contaminants and the chlorine in the supply water. Brackets 23 connected to a wall 21 of the housing 11 clamp the filters 20, 22 in position. It should be noted that the filters although preferred are not necessary for the chilling apparatus, and thus do not form a part of the invention.

The outlet of the filter 22 is connected to a "Tee" coupling or a fitting 24 which has the exit end, i.e., the end which is in line with the inlet, connected to a shut-off valve 26 and its other outlet end, i.e., the one which is disposed substantially 90 degrees to the inlet, connected through a fitting 28 to a small tube 30 which extends slightly down into a cooling or chilling tank 32 having a thermally insulated wall structure 33. Extending through a hole in the wall of the tank 32 is a thermally conductive probe 34 which in accordance with the disclosure in the aforesaid U.S. Pat. No. 5,544,489 is connected through a conductive base portion 36 of the probe to a thermoelectric device 38 which in turn is connected to a heat sink 40. The thermoelectric device 38 is a commercially available device producing a reduced temperature on one side and a raised temperature on the other side when a d.c. voltage is applied through conductors 42 from a power source 44. The cold side of the device faces the interior of the chilling tank 32 and the hot side faces the heat sink 40. The probe 34 is cooled by conduction of the cold side of the thermoelectric device 38 through the base of the probe. A fan 46 may act to blow air to withdraw heat from the heat sink 40 as in the aforesaid U.S. Pat. No. 5,544,489, the disclosure therein being incorporated herein by reference, the fan also receiving electricity from the power source. This is the preferred mode of the invention although other cooling means such as a refrigeration cycle or other cooling means known in the art may be used, albeit the unit would be larger to receive cooling coils therein.

The outlet of the valve 26 is connected to another "Tee" coupling or fitting 48 having its aligned outlets connected respectively to a tube 50 which extends into the cooling or chilling tank 32 and its other end connected to a swivel spout 52. The spout 52 is connected by a bulkhead type fitting 54 which permits the spout to swivel in a 360 degree radius. The tube 50 preferably is plastic and extends downwardly toward the base of the tank adjacent a wall thereof. The tube 50 includes a small vent hole 56 disposed below the top of the tank to allow the tank to fill to the level of the vent hole and leave an air space between the vent hole and the top of the tank. This air space acts to a certain extent as an insulation layer.

When the faucet diverter valve 16 is engaged, water flows into the inlet 18 or, if there are filters as described, into the filter system from the faucet of the sink. The water flows into the cooling tank 32 when the valve 26 is closed and pressurizes the tank 32. As the water is chilled and an ice ball 58 forms about the probe 34, when the valve 26 is closed by means of an operator or handle 60, any water flowing into the tank results in water flowing through the tube 50 and up and out through the spout 52. The water temperature may be adjusted by the shut-off valve 26 to allow from zero to approximately 90 percent of the water exiting the spout to be at room temperature. If chilled water is desired, the valve 26 is shut and all the water flows through the tube 30. If only a small amount of chilled water is to be mixed with room temperature water, the valve 26 is opened fully. By mixing and modulating the amount of room temperature and chilled water, by turning the valve operator 60, the temperature of the water exiting the spout may be raised or lowered as desired. Typically, the initial water from the tank will be very cold, and by mixing this cold water with room temperature water the output of the normally chilled water capacity may be greatly increased. If chilled or cooled water is not desired, the diverter valve 16 is disengaged.

Variations and additions to this system may prove fruitful. For example, a drip valve in the inlet line may allow water inside this spout to return to the tank to prevent the water from spilling as a result of the expansion of the ice ball. Moreover, a custom diverter valve that would permit water to flow back from the inlet tube without loss of water pressure into the tank may also prove helpful.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having set forth the nature of the invention, what is claimed herein is:

1. Chilling apparatus for chilling water received from a supply at entering temperature and dispensing chilled water or a mixture of chilled water and entering temperature water through a spout, said apparatus comprising: a chilling tank, a cooler including a cooling element disposed within said tank, a conduit having an inlet for receiving entering temperature water from a supply and having a pair of outlets, a first of said outlets communicating with said tank to supply entering temperature water thereto, a valve operable between an open position permitting water to flow therethrough and a closed position preventing water to flow therethrough and having a plurality of positions intermediate said open and said closed positions, said valve having an inlet end and an outlet end, a second of said conduit outlets disposed in flow communication with the inlet end of said valve, a chilled water supply tube extending into said tank and having a first end in said tank and a second end, a spout having a supply end connected in flow communication with the second end of said supply tube and with the outlet end of said valve, and a valve operator for varying the positions of said valve between said open position, said intermediate position and said closed position to vary the temperature of water exiting said spout.

2. Chilling apparatus as recited in claim 1, wherein said cooling element comprises a cooling probe cooled by thermoelectric means.

3. Chilling apparatus as recited in claim 1, wherein said first end of said supply tube is disposed adjacent said cooling element.

4. Chilling apparatus as recited in claim 3, wherein said cooling element comprises a cooling probe cooled by thermoelectric means.

5. Chilling apparatus as recited in claim 1, including filtering means communicating with the inlet of said conduit for receiving water from said supply and supplying filtered water to said inlet of said conduit.

* * * * *